US005308674A

United States Patent [19]

Zafiroglu

[11] Patent Number: 5,308,674

[45] Date of Patent: May 3, 1994

[54] TEAR-RESISTANT STITCHBONDED FABRIC

[75] Inventor: Dimitri P. Zafiroglu, Greenville, Del.

[73] Assignee: E. I. du Pont de Nemours and Company, Wilmington, Del.

[21] Appl. No.: 979,008

[22] Filed: Nov. 13, 1992

Related U.S. Application Data

[63] Continuation-in-part of Ser. No. 675,224, Mar. 26, 1991, abandoned.

[51] Int. Cl.[5] ..... B32B 3/06

[52] U.S. Cl. ..... 428/102; 428/369; 66/192

[58] Field of Search ..... 428/102, 369; 66/192

[56] References Cited

U.S. PATENT DOCUMENTS

| | | | |
|---|---|---|---|
| 4,704,321 | 11/1987 | Zafiroglu | 428/102 |
| 4,737,394 | 4/1988 | Zafiroglu | 428/102 |
| 4,773,238 | 9/1988 | Zafiroglu | 66/192 |
| 4,876,128 | 10/1989 | Zafiroglu | 428/102 |

OTHER PUBLICATIONS

Product Licensing Index Research Disclosure, "Stitchbonded Products of Continuous Filament Nonwoven Webs," (Jun. 1968).

*Primary Examiner*—Alexander S. Thomas

[57] ABSTRACT

An improved stitchbonded fabric, particularly suited for industrial fabric uses, has high tear strength and is made by multi-needle stitching a fibrous layer with a bulkable non-elastomeric yarn that forms spaced apart, interconnected rows of stitches which amount to 25 to 65% of the total weight of the fabric.

9 Claims, 1 Drawing Sheet

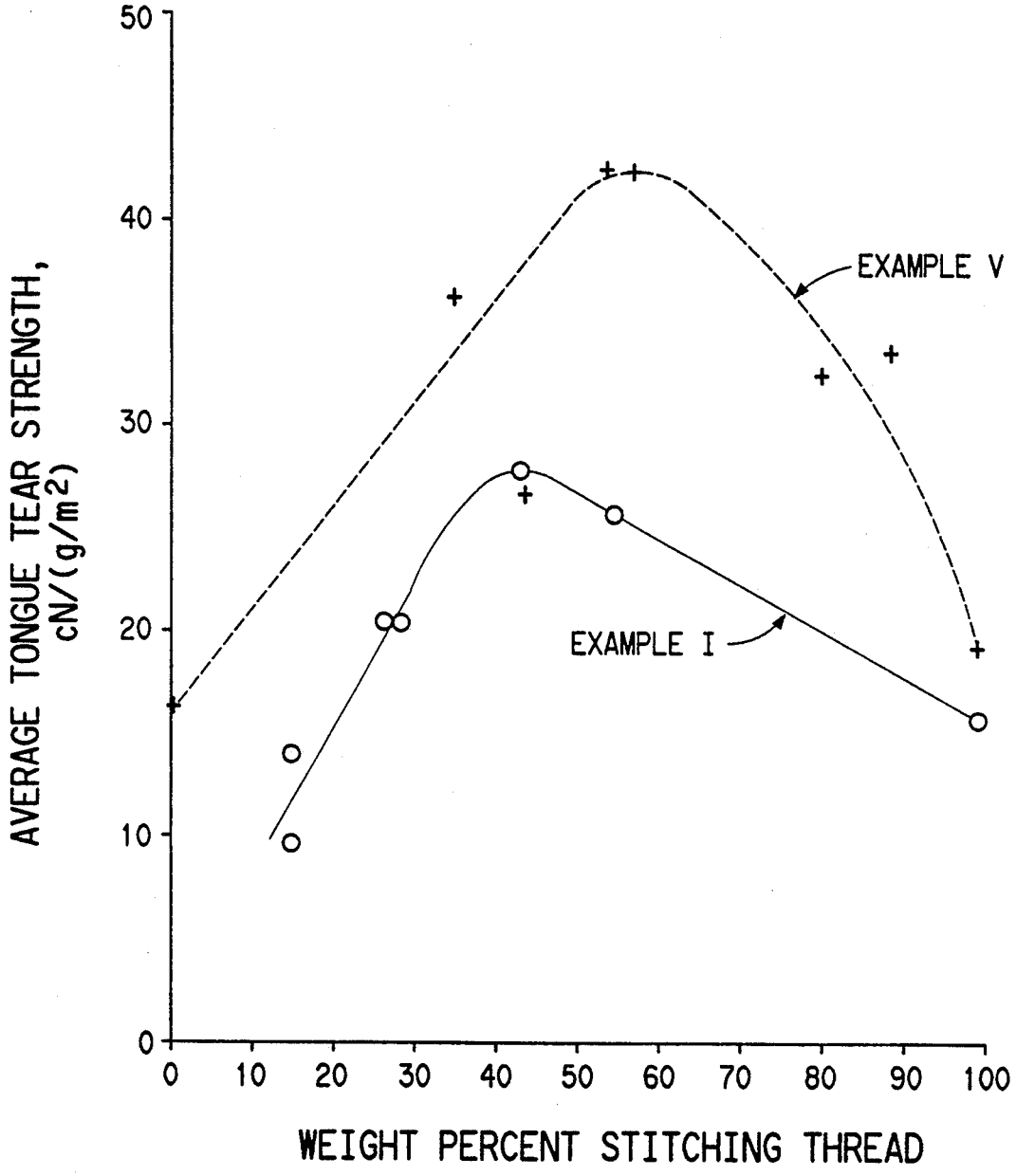
AVERAGE TONGUE TEAR STRENGTH, cN/(g/m²)
50
40
30
20
10
0
0
10
20
30
40
50
60
70
80
90
100
WEIGHT PERCENT STITCHING THREAD
EXAMPLE V
EXAMPLE I

TEAR-RESISTANT STITCHBONDED FABRIC

RELATED APPLICATION

This is a continuation-in-part application of application Ser. No. 07/675,224, filed Mar. 26, 1991, abandoned.

BACKGROUND OF THE INVENTION

1. Field of the Invention

The present invention relates to a stitchbonded nonwoven fabric having a fibrous layer and spaced apart, interconnected rows of bulkable thread stitches. In particular, the invention concerns such a fabric in which the bulkable threads are non-elastomeric and amount to 25 to 60% of the total weight of the fabric. The fabric has high tear resistance and is especially suited for use in industrial applications, such as tarpaulins, geotextiles, coated fabric, automobile airbags, banners, furniture decking, fabric liners, apparel interliners and the like.

2. Description of the Prior Art

Stitchbonded fabrics are known in the art. Such fabrics are often made by multi-needle stitching of a fibrous layer with one or more stitching thread systems. The stitching forms spaced apart, interconnected rows of stitches, usually at a spacing in the range of 2 to 8 rows per centimeter. In each row, stitch spacing is in the range 2 to 10 stitches per cm. Typically, the stitchbonded fabric is made with a fibrous layer of staple fibers of textile decitex (e.g., 1 to 15 dtex), and ordinary stitching threads (e.g., of nylon, polyester, acrylic or natural fibers). Stitchbonding of fibrous layers of continuous filament webs is also known, as for example from Product Licensing Index, Research Disclosure, page 30, (June 1968).

Use of elastic or bulkable stitching thread for making bulky and/or stretchy stitchbonded fabrics is a more recent development in the art. Such fabrics are disclosed, for example, in my earlier U.S. Pat. Nos. 4,876,128, 4,773,238, 4,737,394 and 4,704,321. Usually, the stitched fabric is allowed to shrink and gather immediately after the multi-needle stitching operation to effect a very large reduction in fabric area. A fibrous layer of polyolefin plexifilaments stitchbonded with a bulkable stitching thread which amounts to a maximum of 40% of the total weight of the fabric is disclosed in the patents, but much lower yarn contents are specifically disclosed in the examples. The bulkable stitching thread usually is an elastic yarn that preferably comprises spandex elastomeric filaments wrapped with nylon yarns and is capable of elongating and retracting in the range of 100 to 250%. Bulkable stitching threads of yarns that are heat shrinkable, textured, or otherwise stretch yarns, made from polyester, nylon, or other polymers, are disclosed to function in a similar manner to spandex yarns but with less elongation and contraction.

Stitchbonded nonwoven fabrics made with bulkable yarns usually have high specific volume (i.e., bulk) and high tensile strength and are suited particularly for use as insulation fabrics, special elastic fabrics, dust wipes, and the like. However, such stitchbonded fabrics, unless of heavy weight, usually lack the high tear resistance desired for industrial fabrics.

It is an object of this invention to provide a stitchbonded nonwoven fabric that has high tear resistance and is suitable for use as an industrial fabric.

SUMMARY OF THE INVENTION

The present invention provides an improved stitchbonded fabric. The fabric is of the type that has a fibrous layer multi-needle stitched with a bulkable nonelastomeric thread system that forms spaced apart, interconnected rows of stitches. In accordance with the improvement of the invention, the fibrous layer comprises fibers or filaments of textile decitex, and optionally woodpulp fibers amounting to as much as 65% of the fibrous layer weight and the bulkable thread is a non-elastomeric stretch yarn amounting to 25 to 65%, preferably 30 to 45%, of the total weight of the fabric. Preferably, the stitchbonded fabric has a recoverable area stretch in the range of 5 to 30% and a specific volume of greater than 5 $cm^3$/gram. Also, the stitchbonded fabric preferably has a tear strength per unit fabric weight in the longitudinal and transverse directions of the fabric of at least 35 centiNewtons per gram/square meter. The fibrous layer is of substantially nonbonded staple fibers or continuous filaments. A preferred fibrous layer is of continuous polyester filaments. The bulkable thread is preferably a textured yarn of synthetic organic filaments, most preferably of polyester or nylon. The interconnected rows of bulkable thread stitches are formed by one or two stitching thread systems (i.e., one or two bars of stitchbonding machine).

BRIEF DESCRIPTION OF THE DRAWING

The invention will be better understood by reference to the attached drawing which graphically displays tongue tear strengths of the fabrics of Examples I and V below as functions of the weight of stitching thread in the fabric. Each fabric was prepared by multi-needle stitching a fibrous layer with textured bulkable nonelastomeric stitching thread. The fabric of Example I was made with a nonwoven fibrous layer of staple fibers. For Example V, the nonwoven fibrous layer was of continuous polyester filaments. Note that in each case the maximum advantage in tear strength occurs in the range of 25 to 65 weight percent stitching thread content of the fabric. Usually, one makes fabrics of the invention with stitching thread contents in the region near the maximum tear strength. However, for reasons of economy, it is preferred to select yarn contents on increasing side of the graph (i.e., between 25% and the stitching thread content and the maximum tear strength) rather than on the decreasing side (i.e., between the stitching thread content at the maximum tear strength and contents greater than that).

DETAILED DESCRIPTION OF PREFERRED EMBODIMENTS

The invention will now be described in greater detail with regard to preferred embodiments of the invention. The fabric is made from a fibrous layer comprised of filaments or fibers of textile decitex (i.e., about 1 to 15 decitex) and at least one bulkable yarn system that provides spaced apart, interconnected rows of stitches in the fabric.

Various starting fibrous layers are suitable for use in the present invention. For example, batts of carded fibers, air-laid fiber batts, sheets of hydraulically entangled staple fibers (optionally containing up to 65 weight percent of woodpulp), continuous filament webs and the like. The fibers can be natural fibers or fibers of synthetic organic polymer. The fibrous batts or sheets usually are supplied as wound-up rolls. If heavier starting fibrous layers are desired, two or more batts or sheets can be positioned in face-to-face relationship for subsequent stitching together. Fibrous layer weights are usually in the range of 50 to 150 g/m$^2$, preferably 60 to 100 g/m$^2$.

The starting fibrous layers are usually "substantially nonbonded". As used herein, this term means that the fibers generally are not bonded to each other by for example, chemical or thermal action. However, a small amount of bonding is intended to be included in the term "substantially nonbonded". As long as the amount of bonding does not prevent the fibers of the layer from engaging and interlocking with the bulkable threads during multi-needle stitching in accordance with the invention, the fibers are considered to be substantially nonbonded.

As used herein, the terms "bulkable thread" or "bulkable yarn" refer to non-elastomeric thread or yarn that is capable of being "bulked" by being deformed out of plane. The deformation can be induced by release of tension or by exposure to chemical action, moisture and/or heat. Usually the bulkable thread is a "stretch" or "textured" yarn of continuous filaments of thermoplastic polymer, such as polyester and nylon, and is capable of a pronounced degree of stretch and rapid recovery. This property is imparted to the bulkable yarns by having been subjected to a combination of deforming, heat-setting and developing treatments. Among the yarns included in the term "bulkable yarns" are crimped yarns (e.g., stuffer-box crimped, edge-crimped, and knit, heat-set and de-knit yarns) and torque twist yarns (e.g., yarns which are sequentially twisted, heat-set and untwisted or simultaneously false-twisted and heat-set). Bulkable yarns, generally have a recoverable elongation, depending on how they are made and utilized, in the range of about 10 to 250% or more. For example, crimped yarns can have as much as 250% recoverable elongation (sometimes referred to as "crimp elongation"). If the yarns are used with all the crimps straightened, the yarn still may be elongated somewhat further in accordance with the stress-strain characteristics of the filaments themselves. When crimped yarns are stitched into the fibrous layer, the yarns are under tension and much of the crimp elongation is removed, but the tension is adjusted so that the remaining recoverable elongation provides the stitched fabric with a recoverable area stretch in the range of 5 to 30%.

Various multi-needle stitching patterns are suitable for preparing the interconnected, spaced apart rows of stitches of bulkable non-elastomeric thread. In describing the stitch patterns herein, conventional warp-knitting nomenclature is used. When a one-bar stitchbonding machine is employed, "tricot" stitching can be used. As used herein, typical "tricot" patterns include a 1 and 1 lap (1-0,1-2), a 2 and 1 lap (1-0,2-3), a 3 and 1 lap (1-0,3-4), and the like. When a two-bar stitchbonding machine is used, additional stitch patterns can be used, as long as the patterns combine to provide the desired interconnected, spaced apart rows of non-elastomeric bulkable yarn stitches. Typical two-bar stitch patterns include, tricot stitches formed with one bar combined with chain stitches (e.g., 1-0,0-1 and the like), tricot patterns or even laid-in stitches (e.g., 0-0,2-2, 0-0,3-3, 0-0,4-4, and the like) formed with the other bar. In the stitched fabrics of the invention, the bulkable, non-elastomeric stitching thread amounts to 20 to 65%, preferably 30 to 45%, of the total weight of the fabric.

The stitchbonded fabric is useful in the as-stitched condition (i.e., as greige fabric). However, the fabric optionally can be subjected to a finishing treatment. The particular finishing treatment selected depends on the properties of the stitchbonded fabric and on the requirements of the fabric in use. A preferred finishing treatment for activating and heat-setting the non-elastomeric bulkable stitching yarns involves exposing the stitched fabric to heat and moisture while the fabric is restrained from shrinking its area by more than 25%. This can be achieved by "steam pressing", or by hot moist calendering, or by hot tentering under restraint. For example, tentering favors increased fabric bulk (i.e., specific volume) while pressing or calendering of the fabric favors decreased bulk and increased intermeshing of yarns and web. Regardless of the finishing treatment utilized, fabrics of the invention are quite bulky, having specific volumes usually in excess of 5 cm$^3$/gram. In performing any of the optional finishing treatments, excessive shrinkage is avoided so that the fabric can retain satisfactory tear resistance per unit weight. Usually shrinkage during finishing is controlled to be in the range of 10% to 20%. Shrinkages of more than about 25% are detrimental to fabric tear strength.

Stitchbonded fabrics of the invention, whether subjected to a finishing treatment or not, generally are capable of area expansion in the range of about 5 to 30%, and fully recovering from the expansion. In most cases, the recoverable linear extension in the longitudinal, transverse and diagonal directions is greater than 10%. Also, the stitchbonded fabrics of the invention generally possess tear strengths that are greater than those of most industrial high-performance fabrics of the same weight made from similar yarns.

The fabrics of the invention can be made on conventional stitchbonding machines or warp knitting machines that are equipped with one or more needle bars, means for controlled feeding of fibrous layer under low tension, and means for controlling tension on stitching yarns fed to the machine.

TEST PROCEDURES

In the preceding description and in the Examples below, various properties and characteristics are reported for the stitchbonded fabrics and the components used to produce them. These properties and characteristics were measured by the following procedures.

Unit weight of a stitchbonded fabric or of a fibrous layer was measured in accordance with ASTM Method D-3776-79. The weight of stitching thread per unit of stitched fabric was determined during fabric fabrication from measurements of the yarn consumed per unit width and per unit length of fabric formed on the stitchbonding machine. The relative weights of fibrous layer and stitching yarn also could be determined from the total weight of a given area of stitched fabric and the weight of all stitching yarn carefully removed from that area.

Specific volume or "bulk" in cm$^3$/g was determined from the unit weight and thickness of the stitchbonded fabric. The thickness was measured with a conventional thickness gauge having a right cylindrical foot of ½-inch (1.25-cm) diameter loaded with a 10-gram weight.

Tear resistance (i.e., tongue tear) was measured by ASTM Method D 226164T/C-14-20. Grab tensile strength was measured in general accordance with ASTM Method D 1117-80. An Instron tensile testing machine, a 4-inch (10.2-cm) wide by 6-inch (15.2-cm) long sample, a gauge length of 3 inches (7.6 cm), clamp jaws of 1-inch (2.5-cm) width, and an elongation rate of 12 inches (30.5 cm) per minute were used. Each reported longitudinal direction (referred to herein as "MD") measurement and each transverse direction (referred to herein as "XD") measurement was the average of ten determinations in Examples I through IV and of three determinations in Example V, below. Tongue tear strength and grab tensile strength were each reported in centiNewtons per unit weight, $cN/(g/m^2)$.

The percent area expansion that a stitchbonded fabric can experience after stitching can be determined straight-forwardly from instron measurements of the recoverable stretch of the fabric in the longitudinal and transverse directions. However, in the examples below, the recoverable area stretch was determined from the area contraction that occurs in the fibrous layer during stitchbonding. To determine the contraction, the number of stitches were counted in the "MD" and "XD" directions of a 2-inch by 2-inch (5.08 by 5.08 cm) square the sides of which were cut parallel the MD and XD. From the nominal machine settings of stitch and row spacing, the original MD and XD lengths of the square (i.e., the lengths required to make the same number of MD and XD stitches) were determined. The ratio of the final length to the original length in each direction determined the linear contraction of the fabric in each direction. Area contraction, C, was calculated from the product of these two linear contractions and expressed as a fraction of the original area. The percent recoverable area stretch, S, that the fabric can subsequently experience is then calculated by the formula, $S=100(1-C)$. A small amount of stretch beyond the calculated value of S may still remain in the fabric in certain instances, such as when threads of crimped filaments are not stitched in a fully straightened condition.

EXAMPLES

The examples which follow illustrate the present invention, but are not intended to limit its scope; the scope is defined by the claims below.

The examples illustrate the preparation of multi-needle stitched nonwoven fabrics in accordance with the invention and compare the fabrics with similar multi-needle stitched fabrics which are outside of the invention. The examples demonstrate the unexpectedly large advantage in tear strengths possessed by stitchbonded fabrics of the invention containing 25–65% bulkable non-elastomeric stitching thread over comparison fabrics containing less or more stitching thread.

In the examples, samples of the invention are designated with Arabic numerals and comparison samples are designated with upper-case letters. All stitchbonded samples of the invention and all stitchbonded comparison samples were multi-needle stitched with a stitch frequency of 12 stitches per inch (4.7/cm) in the longitudinal direction (i.e., MD) of the fabric with a 12 gauge needle bars that formed 12.2 rows of stitches per inch (4.8/cm) in the transverse direction (i.e., XD), except in Example V, wherein the MD stitch frequency was 9 stitches per inch (3.5/cm). Needle bars that were used in stitching the fibrous layers were always fully threaded.

The following designations were used to identify particular stitching threads. Bulkable non-elastomeric threads:

Y-1. 44-dtex, 13-filament, textured nylon yarn
Y-2. 77-dtex, 34-filament, textured nylon yarn
Y-3. 165-dtex, 34-filament, textured nylon yarn
Y-4. 165-dtex, 34-filament, textured polyester yarn
Y-5. 77-dtex, 34-filament, textured polyester yarn Elastomeric yarn:

W-1. 44-dtex "LYCRA" spandex wrapped with 22-dtex nylon (total 66 dtex)
W-2. 155-dtex, bare "LYCRA" spandex ("LYCRA" is sold by E. I. du Pont de Nemours & Co.)

Non-bulkable, non-elastomeric, flat yarns:

N-1. 44-dtex, 34-filament nylon yarn
N-2. 165-dtex, 34-filament polyester yarn

The textured and flat yarns of nylon had a tenacity of about 4.25 g/den (3.75 deciNewtons per tex) and the polyester yarns, about 3.5 g/den (3.1 dN/tex).

In each example, a summary table lists other construction details as well as properties of the resultant fabric samples (e.g., recoverable stretch, bulk, tensile strength and tear strength).

EXAMPLE I

This example demonstrates the superior strength, especially tear strength, that is achieved by fabrics of the invention that were made with multi-needle stitched layers of staple fibers.

Four samples of the invention (1, 2, 3, 4) and four comparison samples (A, B, C, O) were prepared on a two-bar LIBA machine. Samples 1, 2, 3, 4, A and B were prepared with a fibrous layer formed from one or two sheets of "SONTARA" 8411, a hydraulically entangled, 1.1-oz/yd$^2$ (37-g/m$^2$) sheet, consisting essentially of 70% by weight of 1-inch (2.5-cm) long rayon staple fibers of 1.7 dtex and 30% of ⅞-inch (2.2-cm) long polyester staple fibers of 1.5 dtex. "SONTARA" is sold by E. I. du Pont de Nemours & Co. The fibrous layer of each of Samples 1,3,4 and C was composed of one "SONTARA" sheet and each of Samples 2, A and B was composed of two "SONTARA" sheets each. Except for Comparison Sample C, 0-1, 1-0 pillar stiches were formed with one bar and 1-0,2-3 "tricot" (2 and 1 lap) stitches with the second bar. Sample O was made with no fibrous layer, i.e., with 100% stitching thread. Sample C, only one bar was threaded and it formed 1-0,1-2 tricot stitches. Further details of the construction and properties of the fabrics are summarized in Table I.

TABLE I

| Example I | | | | |
|---|---|---|---|---|
| Samples of Invention | 1 | 2 | 3 | 4 |
| Total weight, g/m$^2$ | 88 | 130 | 88 | 138 |
| Stitching thread | Y-1 | Y-2 | Y-2 | Y-3 |
| Wt. % stitching | 29 | 27 | 43 | 57 |
| Bulk, cm$^3$/g | 10.8 | 10.2 | 9.2 | 9.0 |
| S, % area stretch* | 27 | 16 | 10 | 18 |
| Grab tensile strength | | | | |
| MD, cN/(g/m$^2$) | 217 | 206 | 255 | 277 |
| XD, cN/(g/m$^2$) | 164 | 226 | 216 | 294 |
| Tongue tear strength | | | | |
| MD, cN/(gm/$^2$) | 17 | 16 | 23 | 21 |
| XD, cN/(g/m$^2$) | 24 | 25 | 33 | 30 |
| Comparison Samples | A | B | C | O |
| Total weight, g/m$^2$ | 192 | 115 | 170 | 44 |
| Stitching thread | Y-1 | Y-1 | W-1 | Y-2 |
| Wt. % stitching | 16 | 16 | 29 | 100 |

TABLE I-continued

| Example I | | | | |
|---|---|---|---|---|
| Bulk, $cm^3/g$ | 8.1 | 7.8 | nm+ | nm |
| S, % area stretch* | 30 | 18 | 245 | nm |
| Grab tensile strength | | | | |
| MD, $cN/(g/m^2)$ | 286 | 101 | 136 | nm |
| XD, $cN/(g/m^2)$ | 207 | 91 | 75 | nm |
| Tongue tear strength | | | | |
| MD, $cN(g/m^2)$ | 9 | 8 | 5 | 14 |
| XD, $cN(g/m^2)$ | 19 | 11 | 3 | 16 |

*=recoverable stretch;
+nm=not measured

As shown in the Table I, samples stitchbonded according to the invention with bulkable non-elastomeric yarns Y-1, Y-2 and Y-3, had tear strengths, particularly in the transverse direction (XD), that were much greater than those of the comparison fabrics which were made with insufficient nonelastomeric bulkable thread (Comparison Samples A and B) or with excessively stretchy spandex yarn (Comparison Sample C). The samples of the invention also exhibited higher tongue tear strengths than those of made with 100% stitching thread (i.e., no nonwoven fibrous layer). The average tongue tear strengths of each of the samples (except Sample C), calculated as one half the sum of the MD and XD tears, are displayed graphically in FIG. 1 as a function the weight percent stitching thread in the fabric. Note the maximum that occurs in tear strength at a thread content in the range of 35 to 60%.

EXAMPLE II

This example further demonstrates the strength advantages achieved by fabrics of the invention made with fibrous layers of woodpulp and staple fibers.

Three samples of the invention (5,6,7) and two comparison samples (D,E) were prepared with a fibrous layer that was made of one thickness of "SONTARA" 8801, a hydraulically entangled, 2-oz/yd$^2$ (68-g/m$^2$) sheet, consisting essentially of 45% by weight of $\frac{7}{8}$-inch (2.2-cm) long polyester staple fibers of 1.5 dtex and 55% of pure pine-wood pulp. All samples were two-bar stitched as in Example I, Sample 1, except Sample 7 which was stitched with a single bar, as in Example I, Comparison Sample C. Further details of fabric construction and properties are summarized in Table II.

TABLE II

| | Example II | | | | |
|---|---|---|---|---|---|
| | Of Invention | | | Comparisons | |
| Samples | 5 | 6 | 7 | D | E |
| Total weight, $g/m^2$ | 107 | 139 | 100 | 83 | 90 |
| Stitching thread | Y-2 | Y-4 | Y-4 | Y-1 | N-2 |
| Wt. % stitching | 29 | 42 | 33 | 7 | 21 |
| Bulk, $cm^3/g$ | 10.1 | 9.1 | 8.2 | 8.8 | nm+ |
| S, % area stretch | 6 | 12 | 8 | 11 | 1 |
| Grab tensile strength | | | | | |
| MD, $cN/(g/m^2)$ | 274 | 284 | 257 | 140 | 175 |
| XD, $cN/(g/m^2)$ | 230 | 106 | 96 | 99 | 209 |
| Tongue tear strength | | | | | |
| MD, $cN/(g/m^2)$ | 20 | 22 | 17 | 9 | 7 |
| XD, $cN/(g/m^2)$ | 29 | 28 | 20 | 13 | 10 |

+=not measured

Table II shows that samples prepared according to the invention with bulkable non-elastomeric yarns Y-2 and Y-4 generally had higher tensile strengths and much higher tear strengths than comparison samples that were made with insufficient non-elastomeric bulkable thread (Sample D) or with a substantially non-bulkable nylon thread (Sample E).

EXAMPLE III

This example demonstrates the very large advantages in tear strength possessed by multi-needle stitched fabrics of the invention made with fibrous layers of nonbonded continuous filaments.

Three samples of the invention (8, 9, 10) and three comparison samples (F, G, H) were prepared with a fibrous layer that was made of "REEMAY" consolidated, nonbonded sheet of continuous polyethylene terephthalate filaments of 1.5 dtex containing about 5% of copolyester binder filaments and weighing about 0.7 oz/yd$^2$ (24 g/m$^2$). "REEMAY" sheet is sold by Reemay Inc. of Old Hickory, Tenn. All samples were two-bar stitched as in Example I, Sample 1, with 0-1,1-0/1-0,2,-3 stitches. The of the fibrous layer of Sample 8 was formed made with one sheet of "REEMAY; of Samples 9, 10, G and H, with two sheets; and of Sample F, with three sheets. Table III, summarizes further details and shows, as did the preceding examples, that the fabrics of the invention of this example had a significant advantage in tear strength per unit weight over the comparison samples.

TABLE III

| | Example III | | | | | |
|---|---|---|---|---|---|---|
| | Of Invention | | | Comparisons | | |
| Samples | 8 | 9 | 10 | F | G | H |
| Total weight, $g/m^2$ | 178 | 100 | 90 | 105 | 80 | 70 |
| Stitching thread | Y-4 | Y-2 | Y-2 | Y-1 | Y-1 | N-1 |
| Wt. % stitching | 64 | 31 | 27 | 8 | 14 | 28 |
| Bulk, cm3/g | 9.8 | 8.2 | 6.8 | 6.7 | 8.8 | 3.9 |
| S, % Area stretch | 22 | 29 | 25 | 18 | 24 | 2 |
| Grab tensile strength | | | | | | |
| MD, $cN/(g/m^2)$ | 286 | 322 | 272 | 265 | 292 | 194 |
| XD. $cN/(g/m^2)$ | 120 | 223 | 194 | 216 | 268 | 174 |
| Tongue tear strength | | | | | | |
| MD. $cN/(g/m^2)$ | 49 | 42 | 39 | 10 | 17 | 9 |
| XD. $cN/(g/m^2)$ | 67 | 28 | 37 | 14 | 20 | 17 |

EXAMPLE IV

In this example, three samples of the invention and two comparison samples were prepared with the same fibrous sheets of nonbonded continuous polyester filaments as were used in Example III. The fibrous sheets were stitched with one thread system (i.e., one needle bar) to form 2 and 1 laps (i.e., 1-0,2-3) in Samples 11 and 12 and 1 and 1 laps (i.e., 1-0,1-2) in Sample 13 and Comparisons I and J. Samples of the invention were stitched with bulkable non-elastomeric stretch yarn. Sample I was stitched with non-bulkable nylon yarn and Sample J was stitched with a spandex elastomeric yarn. The fibrous layer of all samples, except Sample 12, was formed with one sheet of "REEMAY"; two sheets were used in Sample 12. Further details are summarized in Table IV.

TABLE IV

| | Example IV | | | | |
|---|---|---|---|---|---|
| | Of Invention | | | Comparisons | |
| Samples | 11 | 12 | 13 | I | J |
| Total weight, $g/m^2$ | 57 | 90 | 119 | 35 | 90 |
| Stitching thread | Y-1 | Y-4 | Y-2 | N-1 | W-2 |
| Wt. % stitching | 26 | 33 | 43 | 29 | 23 |
| Bulk. $cm^3/g$ | 9.1 | 7.8 | 8.1 | nm+ | nm |
| Area stretch*, % | 12 | 14 | 18 | 2 | 63 |
| Grab tensile strength | | | | | |

TABLE IV-continued

| Samples | Example IV Of Invention 11 | 12 | 13 | Comparisons I | J |
|---|---|---|---|---|---|
| MD, cN/(g/m²) | 353 | 305 | 272 | 177 | 106 |
| XD, cN/(g/m²) | 282 | 217 | 191 | 108 | 96 |
| Tongue tear strength | | | | | |
| MD, cN/(g/m²) | 87 | 72 | 69 | 10 | 7 |
| XD, cN/(g/m²) | 86 | 85 | 57 | 15 | 4 |

+ = not measured;
* = recoverable stretch

These data show, as did those of Example III, that continuous filament fibrous layers apparently provide high grab tensile strengths to all samples. However, the tensile strength of samples prepared in accordance with the invention was at least about 1.5 to 2 times greater than that of the comparison samples. The advantage with regard to tear strength was even greater. Samples stitched with bulkable non-elastomeric thread in accordance with the invention had tear strengths that were 4 to 20 times higher than those of the comparison samples that were stitched with excessively elastic spandex elastomeric yarn (Sample J) or with non-bulkable nylon thread (Sample I).

EXAMPLE V

This example demonstrates the superior tear strength that is achieved by fabrics of the invention made with multi-stitched layers of substantially nonbonded layers of continuous polyester filaments.

In this Example, four samples of the invention (Samples 14, 15, 16 and 17) and three comparison samples (Samples K, L and M) were prepared with a two-bar LIBA multi-needle stitching machine. Each bar was 12 gauge and fully threaded. Two textured polyester yarns, Y-5, were employed with each needle of each needle bar. The two combined yarns amounted to the equivalent of a 154-dtex, 68-filament textured yarn for each needle. For each sample of the invention and for Comparison Samples K, L, and M, the yarns were stitched at a frequency of 9 stitches per inch in the longitudinal direction (MD) and 12 per inch in the transverse direction (XD). With one bar, 1-0,2-3 stitch patterns were formed and with the second bar, 2-3,1-0 stitch patterns were formed. In each sample the stitch patterns were formed to provide 2.25 oz/yd² (76 g/m²) of stitching thread. A different weight of fibrous layer was used in each sample. In Samples 14, 15, 16, 17, L and M, the stitches were inserted into a fibrous layer which was made of nonbonded continuous polyester filaments of about 2.4 dtex. The fibrous layer was "Reemay" manufactured by REEMAY, Inc., of Old Hickory, Tenn. Comparison Sample K was stitched with no fibrous layer and therefore consisted of 100% stitching thread. One additional comparison sample, Comparison Sample N, had 0% stitching, i.e., it consisted only of polyester fibrous layer. Before measuring the tear properties of the samples, each sample was ironed with a steam iron operating at a temperature of 300° F. (149° C.) and then allowed to relax and contract. Further details of the construction and properties of the samples are summarized in Table V.

As shown by the attached graph of average tongue tear strength, i.e., (MD+XD)/2, versus weight percent stitching yarn content of the fabric and the results summarized in Table V, a maximum tongue tear strength per unit weight was achieved in fabrics of the invention at a stitching thread content of about 60 weight percent. Note that the fabric of the invention with the highest measured average tear strength was unexpectedly about 275% and about 255% higher than tear strengths of the comparison fabrics having 0% and 100% stitching yarn.

TABLE V

| Samples | K | Example V L | M | 14 | 15 | 16 | 17 | N |
|---|---|---|---|---|---|---|---|---|
| Total weight, g/m² | 161 | 161 | 171 | 186 | 161 | 212 | 264 | 17 |
| Wt. % stitching | 100 | 89 | 80 | 54 | 58 | 44 | 35 | 0 |
| S, % Area stretch | 65 | 47 | 41 | 14 | 18 | 18 | 18 | nm |
| Tongue tear strength | | | | | | | | |
| MD, cN/(g/m²) | 14 | 28 | 30 | 42 | 48 | 27 | 34 | 11 |
| XD, cN/(g/m²) | 25 | 40 | 34 | 44 | 38 | 27 | 37 | 20 |
| Average, cN/(g/m²) | 19 | 34 | 32 | 43 | 43 | 27 | 36 | 16 |

I claim:

1. An improved stitchbonded fabric having a fibrous layer that is multi-needle stitched with a bulkable non-elastomeric thread that forms spaced apart, interconnected rows of stitches, wherein the improvement comprises the fibrous layer comprising fibers or filaments of textile decitex, optionally containing woodpulp amounting to as much as 65% of the total weight of the fibrous layer, and the bulkable thread being a non-elastomeric yarn amounting to 25 to 65% of the total weight of the fabric.

2. A stitchbonded fabric in accordance with claim 1 wherein the stitchbonded fabric has a recoverable area stretch in the range of 5 to 30% and a specific volume of greater than 5 cm³/gram.

3. A fabric in accordance with claim 2 wherein the bulkable thread amounts to 30 to 45% of the total weight of the fabric.

4. A stitchbonded fabric in accordance with claim 1 wherein the fibrous layer is of staple fibers, or of staple fibers plus woodpulp.

5. A stitchbonded fabric in accordance with claim 1 wherein the fibrous layer is of continuous filaments.

6. A stitchbonded fabric in accordance with claim 5 having a tear strength per unit fabric weight in the longitudinal and transverse directions of the fabric of at least 35 centiNewtons per gram/square meter.

7. A stitchbonded fabric in accordance with any one of claims 1 through 6 wherein the bulkable stitching thread is a textured yarn of polyester or nylon.

8. A stitchbonded fabric in accordance with any one of claims 1 through 6 wherein the interconnected rows of bulkable thread stitches were formed by one or two multi-needle stitching thread systems.

9. A stitchbonded fabric in accordance with any one of claims 1 through 6 wherein the interconnected rows of stitches have a spacing in the range of 2 to 8 rows per centimeter and the stitches in each row have a spacing in the range 2 to 10 stitches per cm, and the decitex of the fibers or filaments is in the range of 1 to 15.

* * * * *